US006419472B2

(12) United States Patent
Kobensen

(10) Patent No.: US 6,419,472 B2
(45) Date of Patent: Jul. 16, 2002

(54) GEAR UNIT FOR A DEEP-BOREHOLE PUMP

(75) Inventor: Erwin Kobensen, Rhede (DE)

(73) Assignee: A. Friedr. Flender AG, Bocholt (DE)

( * ) Notice: Subject to any disclaimer, the term of this patent is extended or adjusted under 35 U.S.C. 154(b) by 0 days.

(21) Appl. No.: 09/776,108

(22) Filed: Feb. 2, 2001

(30) Foreign Application Priority Data

Mar. 8, 2000 (DE) ..... 100 11 187

(51) Int. Cl.[7] ..... F01C 1/08

(52) U.S. Cl. ..... 418/191; 418/206.1; 418/181; 188/252; 188/253; 188/254

(58) Field of Search ..... 418/206.1, 191, 418/181; 188/252, 253, 254

(56) References Cited

U.S. PATENT DOCUMENTS 2,531,319 A * 11/1950 Briggs ..... 418/206.1
4,031,877 A * 6/1977 Fujikawa et al. ..... 418/101
5,179,921 A * 1/1993 Figliuzzi ..... 418/191
5,860,635 A * 1/1999 Morfitt et al. ..... 188/290
6,152,231 A * 11/2000 Edward ..... 418/48

* cited by examiner

*Primary Examiner*—Thomas Denion
*Assistant Examiner*—Theresa Trieu
(74) *Attorney, Agent, or Firm*—Thomas S. Baker, Jr.

(57) ABSTRACT

The gear unit for a delivery pump installed in a deep borehole has a toothed gear unit with a pinion located on input shaft (2) and a gear wheel engaged with the pinion, which gear wheel is located on a vertical output shaft (5) driving the delivery pump. The gear unit is designed as a right-angle unit with a conical pinion gear (3) located on the input shaft (2) and a bevel gear (6) located on the output shaft (5). Located on the input shaft (2) is a gearwheel (10) which together with a second gearwheel (11) forms a gear pump which conveys fluid in a direction opposite the operational direction of rotation of the gear unit.

3 Claims, 2 Drawing Sheets

GEAR UNIT FOR A DEEP-BOREHOLE PUMP

FIELD OF THE INVENTION

The invention relates to a gear unit for a delivery pump installed in a deep borehole and having the characteristic features described in the preamble of Claim 1.

BACKGROUND OF THE INVENTION

Rotating deep-borehole pumps, especially those for the delivery of petroleum, are arranged at the foot of the borehole. They are driven by a rotating rod, which extends beyond the borehole, via a gear unit driven by an electric motor. The drive rod has a small diameter in comparison with its length. When a torque is applied to drive the deep-borehole pump, the drive rod twists in its elastic region and thus acts as a torsion spring which, due to its length, is capable of storing a lot of energy. When the electric motor is switched off or electric power is interrupted, the stored energy is released and introduced into the gear unit and electric motor via the output shaft of the gear unit. Since the running resistances of the gear unit and electric motor are quite low, and the gear unit further increases the RPMs as a function of its gear ratio, extremely high speeds can result from the stored energy when the motion is reversed, which speeds are capable of destroying the entire drive unit in an explosive manner. The drive unit must therefore be equipped with a braking device which makes possible the controlled reduction of the stored energy. Mechanical braking systems have the disadvantage that they are difficult to modulate, are subject to considerable wear, and the pump shaft remains under initial stress (risk of accident).

WO 97/10437 makes known a drive unit for a deep-borehole pump in which a fluid pump is used for the controlled reduction of stored energy from the gear unit output shaft. The fluid pump is connected through a free-wheel clutch with a shaft of the gear unit. During normal operation, i.e. in the direction of delivery of the deep-borehole pump, no rotational motion is transmitted from the freewheel. When the direction of rotation is reversed, the rotational motion is introduced into the fluid pump. In the process, the fluid pump draws in a viscous fluid from a reservoir and returns it via a restrictor. The restrictor is adjusted or dimensioned such that during the reverse rotation, a gradual reduction of the stored energy occurs and the drive unit thus remains within the allowable RPM-range.

SUMMARY OF THE INVENTION

The object of the invention is to design the generic gear unit such that the input shaft is arranged horizontally and the stored energy from the drive shaft can be dissipated in a simple and controlled manner.

In a generic gear unit, this object is achieved according to the invention by the characteristic features of Claim 1. An advantageous embodiment of the invention is the subject of the subclaim.

The invention has a gear pump integrated into the gear unit, the pump acting as a return-motion brake. Based on the use of a right-angle unit, the input shaft can be arranged horizontally with the drive shaft being vertical as required. The result is a compact gear unit for driving the deep-borehole pump.

The invention is based on the principle that in a gear pump, as is well known, the direction of delivery of fluids is a function of the direction of rotation. In the invention, this fact is exploited through the arrangement of the gear pump such that in the gear unit's direction of operation, air is drawn in at the inlet side, with the result that no fluid is conveyed. In the direction of rotation, which occurs when the gear unit is driven by the stored energy from the drive shaft of the gear unit and the drive rodding of the deep-borehole pump, fluid is conveyed and pressure is built up since the inlet side is located below the level of the fluid. The fluid used is oil which serves simultaneously as a lubricant for the gear unit. The oil is sent into a pressure chamber. The pressure chamber is connected through a restrictor to the interior of the gear unit. The restrictor causes an increase in pressure and thus a controlled reduction in the stored energy. As the RPMs increase, the torque of the gear pump rises and is used for braking.

An embodiment of the invention is shown in the drawing and is described in more detail below:

DETAILED DESCRIPTION OF THE INVENTION

Figure 1:
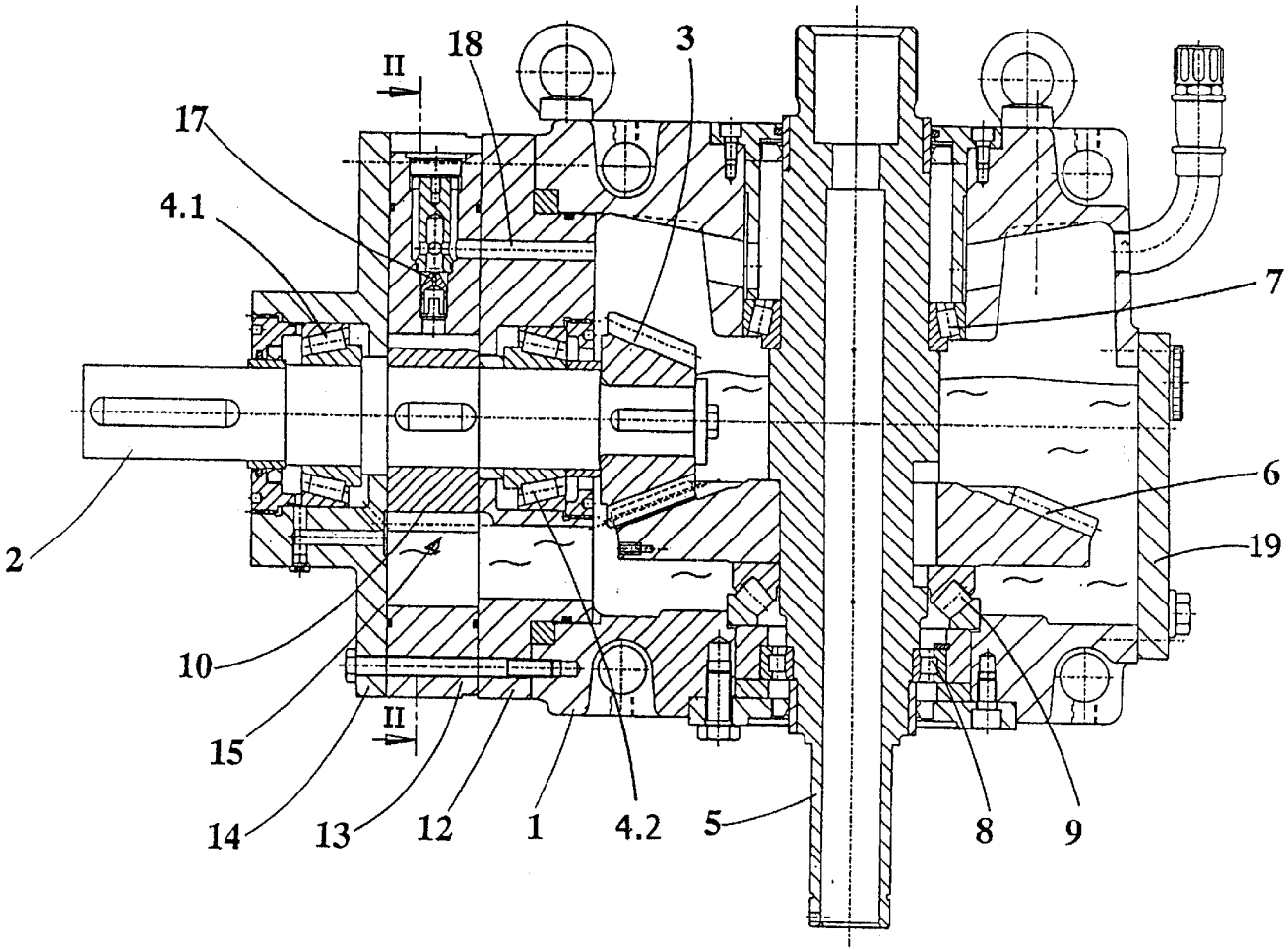
FIG. 1 shows a longitudinal section through a gear unit for a delivery pump corresponding to Section I—I in FIG. 2
Figure 2:
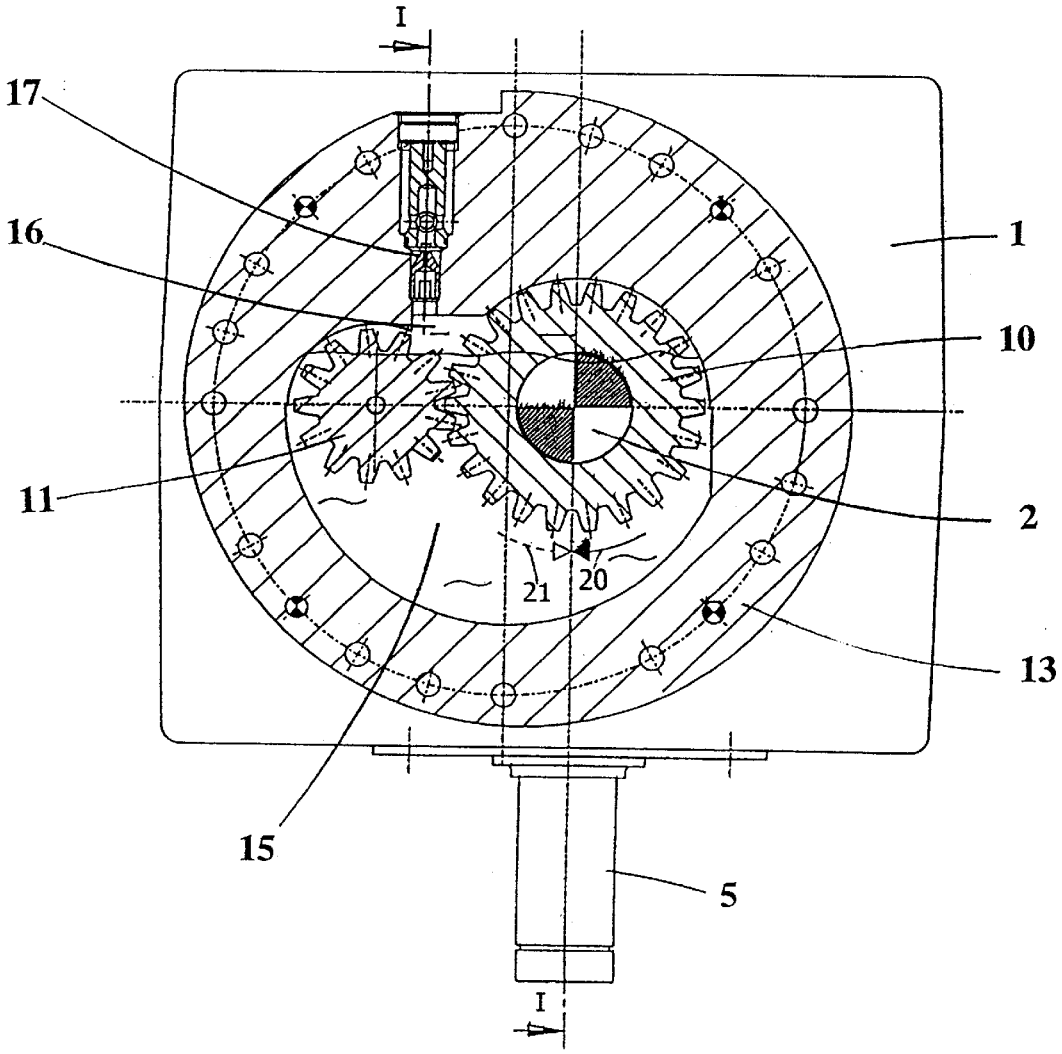
FIG. 2 shows Section II—II of FIG. 1.

The gear unit is a right-angle unit having a horizontal input shaft 2, one end of which extends into gear unit housing 1 and supports at this end a conical pinion gear 3 provided with external toothing. A drive unit (not shown), e.g. an electric motor, engages the outer end of input shaft 2. Input shaft 2 is supported by two bearings 4.1, 4.2, which can be of the same or a different type.

Conical pinion gear 3 meshes with bevel gear 6 provided with a matching external toothing, which pinion gear is rotationally attached to vertically-arranged, hollow drive shaft 5. Drive shaft 5 is supported by two bearings 7, 8 and by thrust bearing 9 in gear unit housing 1. Drive shaft 5 is connected via a rod linkage, not shown, to a delivery pump, also not shown, located in a deep borehole. The function of this delivery pump is to pump the petroleum.

The interior of gear unit housing 1, in which conical pinion gear 3 and bevel gear 6 rotate, is partially filled with lubricating oil up to a fluid level determined by the design.

Gear unit housing 1 is closed on one side by cover 19. At the opposite side, two bearing flanges 12, 14 are screwed onto gear unit housing 1, in which bearings 4.1, 4.2 are provided, which support input shaft 2. Input shaft 2 is sealed where it exits the external bearing flange.

Gripped between bearing flanges 12, 14 is a pump flange 13, which has an internal cavity. Within the cavity of pump flange 13, an initial gearwheel 10 is attached to input shaft 2 in a rotationally fixed manner. Together with second gear 11 located in the cavity of pump flange 13, initial gearwheel 10 forms a gear pump.

One pump chamber 15 of the gear pump is connected to the lubricating-oil-filled interior of gear unit housing 1 below the fluid level. Connected to the other pump chamber 16 is return-flow channel 18, which opens into the interior space of gear unit housing 1 above the level of the fluid. Restrictor 17 is integrated into return-flow channel 18.

During operation of the delivery pump, driven by the gear unit, initial gearwheel 10 of the gear pump rotates together with input shaft 2 and conical pinion gear 3 in the direction of arrow 20. At the same time, air is drawn in at the inlet side in pump chamber 16 and sent by the gear pump into the interior of gear unit housing 1 filled with lubricating oil. During operation, drive shaft 5 twists along with the connected linkage rod, which leads to the delivery pump. When the drive unit is shut off, the energy from twisting, stored in drive shaft 5 and the linkage rod, is released. Through output shaft 5, the released energy turns conical pinion gear 3 and the gear pump's initial gearwheel 10, connected to it via input shaft 2, in the direction of arrow 21. At this rotational direction of the gear pump, pump chamber 15 becomes the suction side. From pump chamber 15, which is connected to the interior of gear unit housing 1 below the fluid level, the gear pump sends lubricating oil into pump chamber 16, which now acts as a pressure chamber, and from there through return-flow channel 18 back to the interior of gear unit housing 1. Due to restrictor 17, located in return-flow channel 18, pressure is built up, which causes energy from drive shaft 5 to dissipate in a controlled manner.

What is claimed is:

1. Gear unit for a delivery pump installed in a deep borehole having: a toothed gear unit with a pinion located on an input shaft (2) and a gear wheel engaged with the pinion, which gear wheel is located on vertical drive shaft (5) driving the delivery pump, the pinion and the gear wheel rotating in an interior partially filled with lubricating oil, and the gear unit being connected to a fluid pump acting as a brake, characterized in that the gear unit is a right-angle unit with a conical pinion gear (3) located on the input shaft (2), and a bevel gear (6) located on the output shaft (5), and that a gearwheel (10) is located on the input shaft (2), which gearwheel together with gearwheel (11) forms a gear pump having a pump chamber (15) wherein said gear pump conveys fluid in a direction opposite the operational direction of rotation of the gear unit.

2. Gear unit according to claim 1, characterized in that the one pump chamber (15) of the gear pump is connected with the lubricant-filled interior below the level of the fluid, and the other pump chamber (16) is connected with the lubricant-filled interior through a restrictor (17) above the level of the fluid.

3. A gear drive for a delivery pump installed in a borehole having: a power driven input shaft adapted to be power driven in one direction, a pinion gear mounted on said input shaft, a vertical delivery pump drive shaft having a drive gear mounted thereon in driving relationship with said pinion, said pinion and said drive gear mounted in a cavity partially filled with lubricating oil, characterized by a second drive gear for a gear pump mounted on said input shaft in a space below said oil level defining a first gear pump chamber, said second drive gear drivingly connected to a third gear mounted in a space above said oil level defining a second gear pump chamber such that said second and third gears form a gear pump which draws air from said second pump chamber and pumps said air freely through said first gear pump chamber when said input shaft is power driven in said one direction to drive said delivery pump drive shaft, a restrictor connected to said second gear pump chamber wherein said gear pump pumps lubricating oil from said first gear pump chamber through said second gear pump chamber and through said restrictor when power is removed from said input shaft and said delivery pump drive shaft drives said input shaft in an opposite direction, said restrictor acting to create hydraulic pressure to retard rotation of said input shaft.

* * * * *